United States Patent [19]

Pletzer

[11] Patent Number: 4,759,312

[45] Date of Patent: Jul. 26, 1988

[54] FURNACE SYSTEM

[76] Inventor: Georg Pletzer, Rosenhügel 48, A-6353 Going, Austria

[21] Appl. No.: 23,860

[22] PCT Filed: Jun. 4, 1986

[86] PCT No.: PCT/AT86/00045

§ 371 Date: Feb. 4, 1987

§ 102(e) Date: Feb. 4, 1987

[87] PCT Pub. No.: WO86/07435

PCT Pub. Date: Dec. 18, 1986

[30] Foreign Application Priority Data

Jun. 12, 1985 [AT] Austria ..... 1746/85

[51] Int. Cl.[4] ..... F22B 31/00

[52] U.S. Cl. ..... 122/24; 431/1

[58] Field of Search ..... 122/24; 431/1; 60/39.77

[56] References Cited

U.S. PATENT DOCUMENTS

| | | | |
|---|---|---|---|
| 2,722,180 | 11/1955 | McIlvaine | 122/24 X |
| 2,729,939 | 1/1956 | Campbell | 60/39.77 |
| 3,267,986 | 8/1966 | Olsson | 431/1 |
| 3,853,453 | 12/1974 | Olsson | 431/1 |
| 4,569,310 | 2/1986 | Davis | 122/24 |

*Primary Examiner*—Edward G. Favors

*Attorney, Agent, or Firm*—Lorusso & Loud

[57] ABSTRACT

In a heat exchange container (1) that is preferably water filled and used in a space or central-heating system a furnace system having a combustion chamber (5) for the pulse combustion of free-flowing, in particular, liquid fuels is used, and this is mounted as a container insert on a carrier plate (2) that closes an opening in the container (1). The air supply takes place intermittently through valves (30) and the fuel supply is continuous and under pressure, through an axially adjustable injection nozzle (29) into a prechamber (10) so that the injection pressure and the position of the injection nozzle (29) constitute important adjustment values. Close to the base of the combustion chamber within the prechamber (10) there is a vortexing element that vortexes the fuel-air mixture that is formed, doing so on the combustion chamber side, the opening cross-section of this vortexing element being adjustable. This, too, constitutes an additional control variable. The combustion chamber (5) is preferably configured so as to be contained in a double jacket, in which connection the double jacket includes a very narrow gap that permits thermal transfer, whereas the double combustion chamber base has a broad, thermal insulating gap.

33 Claims, 5 Drawing Sheets

FURNACE SYSTEM

The present invention relates to a furnace system for an installation that has a heat exchange container, it being preferred that this container be water-filled, said furnace having at least one combustion chamber for the pulse combustion of free-flowing fuels, this being fitted with an ignition system for the initial ignition of the fuel and making a transition to a waste-gas discharge system, and which has feed lines for fuel and air, the latter incorporating a system of non-return valves at the inlet into a prechamber, this system providing for an intermittent supply of air.

An installation of this kind, used mainly as a steam-generating system, is known from FR-A No. 1,023,114. In this, a plurality of combustion chambers is arranged in parallel in a water boiler, on the one side, a prechamber fitted with aerodynamic non-return valves protrudes into an air feed trunk and on the other the ends of the exhaust pipes protrude into a gas-exhaust trunk, through which passes the boiler water feed line for preheating. Steam is discharged from the hottest part of the boiler. There is no possibility of controlling the pulse combustion and there is no mixing zone, so combustion quality is not particularly high.

The present invention relates further, corresponding to FR-A No. 1,023,114—on the one hand—to a furnace with the above-cited features and which has, in addition, a steady fuel supply, this fuel being supplied under pressure through an inlet nozzle, and—on the other hand—to a furnace having the above-cited features, intended especially for the pulse combustion of a free-flowing fuel, the combustion chamber of which is installed in an opening in the water-filled heat exchange container such that it, together with a part of the waste-gas discharge system, is surrounded by water, whereas the prechamber is located outside the heat-exchange container.

Up to the present, the principle of pulse combustion has been little used for purposes of space-heating or central-heating systems, since output control, noise, and quality of combustion have always caused problems. DE-B No. 1 253 851 describes a furnace installed on a heating boiler; in this, the fuel is supplied directly into the combustion chamber by a piston-type pump, the pumping frequency of which can be adjusted. The air is delivered to a plurality of prechambers through non-return valves. The resonant frequency of the combustion chamber is matched by varying the fuel supply frequency so as to keep noise generation as low as possible.

WO-A No. 84 02 762 describes an air non-return valve for a pulse burner that has a prechamber. Within the prechamber an injection nozzle is arranged directly in front of a cross-sectional restriction in the prechamber. The mixing with air that enters all round the injection nozzle thus begins right in the prechamber; this is first continued, however, in the combustion chamber, by the acceleration effect of the restricted prechamber, in which regard the usual operating frequency of the combustion chamber precludes complete, optimal intermixing. Furthermore, there is no provision made for control.

AT-B No. 170 522 describes a pulse burner with an intermittent air supply through a non-return valve into a prechamber in which mixture formation takes place with gaseous fuel. This, too, is drawn in through a nozzle in a low-pressure phase, so that the fuel supply is not continuous. Vortex generators are provided in the prechamber so as to produce vortex cushions, which reduces the effects of pressure spikes on the non-return valve. There is no way of controlling this burner, which operates solely with gaseous fuel, in order that it can be used for a hot-air apparatus.

EP-PS No. 11457 describes a further example, according to which one embodiment is made up from prefabricated component groups, namely, a base section and an exhaust-gas chamber, a middle section and a heating boiler, in which the combustion chamber is incorporated, and an upper section with an air compression chamber and a gas compression chamber; this apparatus burns gaseous fuels exclusively. The combustion chamber is in the form of an almost-spherical insert from which, at the point of its greatest diameter, a waste-gas connector pipe leads tangentially to an intermediate tank or container from which a plurality of curved pipes carry the waste gases into the waste-gas chamber. A prechamber serves to form the gas-air mixture, the gas and the air being supplied separately, and this prechamber has a flame retainer. A system of non-return valves with a plurality of poppet valves is provided, and each poppet valve shuts off the air supply and the gas supply simultaneously. A pressure-control system is incorporated in the gas supply line and this controls the pressure in the gas-compression chamber independently of the pressure in the air compression chamber, so that essentially constant pressure conditions prevail.

The furnace system according to U.S. Pat. No. 4,449,484 is constructed in a similar manner. A prechamber in which the air-fuel mixture is formed is separated from the combustion chamber by a baffle that incorporates an opening of smaller diameter. Supply lines for air and fuel open separately into the prechamber, and these lines are shut off by a common poppet valve. Only gaseous fuels can be burned in a design such as this. The whole of the furnace system is configured as an insert for a boiler.

U.S. Pat. No. 2,715,390 describes a furnace system, the combustion chamber of which is also inserted into a heating boiler. A prechamber is used to form an air-fuel mixture, and a plate valve closes off the transfer port from the prechamber to the combustion chamber.

The output of none of these furnace systems can be controlled in a manner suitable to meet the requirements of a central or space-heating system, even though several proposals have been made in this regard. Thus, in a system according to U.S. Pat. NO. 2,609,660, which shows a non-return valve system in the transition from the prechamber intended for forming the mixture to the combustion chamber, the cross-section of the transfer passage can be changed by means of a rotary slide. Another kind of control is demonstrated in JP-A No. 5895105, according to which a conical retarder body is arranged in an expanded section of the waste-gas pipe; this can be slid far into the waste-gas pipe by means of a lever, thereby changing the cross-section of the waste-gas pipe and the frequency of oscillation. This furnace system, too, has a prechamber that is separated from the combustion chamber by means of a baffle and in which a common plate valve shuts off the air and the gaseous-fuel supply.

It is the task of the present invention to match a furnace system of the type described in the introduction hereto, which is known to be highly efficient, to conventional space- and central-heating systems. This should permit lower waste-gas values so as to comply with current waste-gas regulations, even though only conventional fuels, in particular furnace oil as well as combustible waste products such as waste vehicle lubricating oil and similar substances can be burned in a similar manner. Further to this, this system should both replace existing furnace system, such as oil-fired systems, and permit installation in newer structures without any necessity for modifying the components of the heating system. This also entails another very important task in that the control range for heating systems should be retained for these applications.

These tasks have been solved according to the present invention in that for an application in a space or central-heating system the inlet nozzle for the fuel is arranged in the prechamber, and in that within the transfer area from the prechamber into the combustion chamber there is an element that changes the cross-sectional area of the prechamber, said element forming vortices in the air-fuel mixture on its combustion-chamber side.

Mixing of the air-fuel mixture is optimized by the vortexing of the fuel with the air prior to its being introduced into the combustion zone of the combustion chamber, and simultaneous and even ignition is achieved in the combustion zone, this being prerequisite for the excellent exhaust-gas values set out subsequently. Coarse control of output performance can be achieved by the preferably continuous supply of fuel through the injection nozzle, by simply adjusting the pressure of the oil, in which connection the intermittent supply of air through the air-inlet valve system will be matched automatically to the particular conditions. The element that generates the vortices can be in the form of a baffle that reduces the cross-section of the prechamber and then extends this, so that on the combustion chamber side this acts as a vortexing diffusor. The vortexing element can also be a simple widening of the prechamber. It is also possible to incorporate a baffle in this wider section, which will increase the vortex effect. In a similar manner a venturi tube can be provided as a vortexing element or in addition thereto.

In a preferred embodiment it is foreseen that the vortexing element is arranged in the prechamber at a distance from the combustion chamber. This amounts preferably to 10–20 mm from the base of the combustion chamber. This has been found to produce a particularly good homogeneous mixture.

Output control can be improved and refined by various additional features. It can be arranged that the distance from the vortexing element or the additional baffle to the base of the combustion chamber be adjustable and/or that the width of the opening of the vortexing element be adjustable. A vortexing element of this kind can be formed, for example, as a mechanically adjustable slide baffle.

A baffle that is used as a vortexing element is also part of a flame retainer that helps to vapourize liquid fuel. For the continuous supply of fuel into the prechamber, it has been specially arranged that the fuel supply line enters the prechamber axially and that the inlet nozzle is arranged in the vicinity of the vortexing element. This results in an embodiment in which the inlet nozzle is configured so as to be adjustable between a forward end position at the vortexing element and a rear end position. This adjustment can be made mechanically, pneumatically or hydraulically.

The adjustable vortexing element and/or the longitudinally adjustable inlet nozzle permit the fine adjustment of the mixture composition, so that an almost stoichiometric mixture relationship can be achieved for each output range since the annular air passage gap between the vortexing element and the inlet nozzle can be adjusted, and the air requirement for the quantity of fuel that is required—which depends on the nozzle size and the injection pressure—is adjusted automatically. A preferred range of adjustment for the inlet nozzle lies between 10 and 20 mm in front of the vortexing element. Thus, using one and the same burner it is possible to cover a far greater output range. The control range with an adjustable inlet nozzle and an adjustable vortexing element is approximately three times the control range achievable using non-adjustable components.

The gases generated during combustion flow on the one hand into a connector pipe for the water-gas discharge system, said pipe being joined to the combustion chamber, and on the other they are forced into the prechamber. The air-intake valves shut tight because of the increase in pressure; essentially, these valves are already closed because of their own spring pressure. The gases contained in the prechamber, which is an air-fuel mixture mixed with old gas particles, are precompressed thereby. Thus, the stratum closest to the combustion chamber contains mainly combustion products with still-available, unburned fuel and a small proportion of air. The next layer consists of an air-fuel mist, in which there is a predominance of fuel. The last layer consists of a fuel/air mixture in which the amount of fuel is very slight, i.e. a so-called poor mixture. These different layers are brought into the combustion chamber with the next induction, in which connection the mixture column that enters is agitated a great deal on the vortexing element as a result of its diffusor effect. In this regard, a specific proportion of old gas in the mixture that is entering has been found to be of advantage in reducing the proportion of nitrous oxide in the combustion gases.

During the induction process, the fuel is carried along by the fresh air that is moving at a greater velocity and delivered into the combustion chamber as a fuel/air mixture that is moving at high speed. Because of the additional diffusor effect of the combustion chamber that is wider than the prechamber, the fresh gas that is entering is decelerated and at the same time the pressure increases. This means that the exhaust-gas wave that is flowing back from the exhaust pipe encounters the fresh-gas mixture. In the subsequent, detonation-like combustion process, which is brought about by a practically simultaneous ignition of the total contents of the combustion chamber, and the associated extremely abrupt increase in pressure, the combustion products now not only shoot into the exhaust pipe, but in part flow rapidly back into the prechamber, whereupon they compress the in flowing fuel particles into the prechamber. Only during the subsequent induction process does this mixture—consisting of old gas, fresh air, and fuel once again enter the combustion chamber. This results in a constant vapourization of the fuel, and thus a further prerequisite for optimization of the mixture despite intermittent delivery of the fuel mixture—corresponding to an operating rhythm of the apparatus (approximately 50 Hz)—to the combustion chamber.

An influx inhibitor is necessary for the operation of a combustion chamber with pulse combustion; formerly, this was in the form of a non-return barrier, and now it is usually in the form of non-return valves. If the open valve surface is made too large, it will be impossible to start or run the furnace system. If the open valve surface is too small, not only will the output from the furnace system be too small, but the control range will also be too small. In the furnace system according to the present invention the influx inhibitor is formed not by the air inlet valves, but by the air passage surface between the inlet valve and the vortexing element. Thus the total opening cross-section of the air inlet valves can be as large as desired. This makes one embodiment possible in which the air supply lines has two orifice branches; these open into the prechamber with an axial interval between them, and at least one such branch can be closed off.

The controllability of the furnace system can be improved still further in that the rear end position of the axially adjustable inlet nozzle lies between the two outlet branches of the air supply line. This results in a stratified charge in the combustion chamber, since the first and the last strata contain a higher concentration of air, and the middle stratum contains a higher concentration of fuel.

It is chiefly non-return valves having V-shaped valve seats that have a pair of valve flaps that are best suited as air inlet valves. Since the V-shaped valve seats open only corresponding to the throughput cross-section between the vortexing element and the inlet nozzle, they are only minimally loaded if made overly large, so that to a very great extent they are kept free of wear. As an example, they can be spring-steel plate, or glass- or carbon-reinforced plastic.

In the resting state, the valves have a very small gap, which is designated as a pre-opening and is preferably achieved by slightly convex curvature of the valve seat. A pre-opening should amount to between 0.1 and 0.3 mm at the tip of the valve flaps. The pre-opening ensures that when a small motor-driven fan (start-up fan) is started, air can be passed with very little resistance through the pre-opened valve in order to ventilate the combustion chamber and provide fresh air for starting. The valves open so as to form a gap 2–4 mm wide during operation. The pressure in the combustion chamber holds them tight shut; on the transition from pressure to partial vacuum they move to the pre-open position and are opened to the required throughput cross-section by the fresh air that is drawn in. With curved or arched valve seats, the valve flaps are flat plates that are not under pressure when in the open position and are under tension when in the open and in the closed position. The automatically varied opening of the V-valves is an important component of the infinitely variable controllability of the furnace system.

If the injection pressure, and thus the quantity of fuel, is increased, the pressure variations that occur during combustion will grow greater. This will result in the fact that a greater quantity of air will be drawn in during the induction stage and the velocity of the air will have to increase, which presents no problem on account of the over-large V-shaped valve flaps. As has been discussed, the infinitely variable controllability of the burner results from changing the injection pressure, the fuel/air ratio being essentially stoichiometric across the whole of the control range.

It has also been found to be advantageous if the flaps of the non-return valves are of different materials, it being possible for the non-return valve of the branch closest to the combustion chamber to have valve flaps that are less resistant to flexing so as to permit, first, an air-rich mixture, then a fuel-rich mixture, and finally an air-rich mixture once again to flow into the combustion chamber.

It has been shown in practice that specific size ratios are particularly favourable. Thus, for the combustion chamber a ratio of diameter to length of 1:1.5 to 1:2.5, preferably 1:2 has been found to favourable. The length of the combustion chamber should be approximately 1.5 to 3× its diameter, which corresponds to approximately one- thirtieth part to one-fiftieth of the distance of a first acoustic damper of the waste-gas discharge system from the base to the combustion chamber. This distance amounts, on the other hand, to 40 to 60 times the diameter of the exhaust pipe between the combustion chamber and the first acoustic damper.

An embodiment in which the combustion chamber has a double shell that incorporates a compensator gap has been found to be particularly favourable for the combustion of liquid fuels so as to achieve especially good exhaust-gas values. The inner shell is only connected to the outer shell on the side closest to the base of the combustion chamber, it being preferable that the combustion chamber base be formed of two base plates arranged at an interval from each other, of which the inner forms a heat shield and the outer is conncedted to the carrier plate. It is preferred that this interval be 8–10 mm. This will mean that the carrier plate remains relatively cool.

It has been found to particularly favourable if the heat shield and the inner shell form an insertable, hot chamber that extends into the waste-gas discharge system.

The compensator gap forms not only an expansion zone, but it means that the water strata close to the chamber are not vapourized, so that disruptions of the heating system occasioned by this are avoided. Furthermore, the inner shell is caused to incandesce, and it becomes possible to arrive at environmentally benign exhaust gases having low CO values.

The hot heat shield also acts as a vapourizer plate for the vortexed fuel droplets and, optionally, forms a part of the flame retainer. The compensator gap between the inner shell and the outer shell is preferably 0.2–2.0 mm thick.

The gap should be small enough that the inner shell can expand and the heat can be transferred to the heat-exchange medium. A gap that is too large will reduce the useful life of the material because of excessive heating, whereas on the other hand the nitrogen oxide content of the exhaust gases will be too high, even though lower CO values will result. If the gap is too small, or if there is no gap at all, the combustion chamber will be too cool, which will cause the CO values to increase, although the nitrogen oxide content will drop. Furthermore, this will lead to deposits of oil carbon and soot on the walls of the combustion chamber. The range of gap sizes cited is a good compromise, i.e., lower carbon monoxide values and relatively low nitrogen oxide values at a high proportion of carbon dioxide, as can be seen from the tables of values appended hereto. In total, the controllable fuel pressure and the automatically matched amount of air that is supplied, the adjustable vortexing baffle, the adjustable position of the inlet nozzle, and the hot combustion chamber produce a light-blue, transparent flame and thus optimum combustion across the whole control range of the furnace system.

In order to achieve a further improvement of output control and combustion quality, and a reduction in fuel consumption, one embodiment, in which the air supply line is divided into two branches, is such that the branch of the air-supply line that is close to the combustion chamber opens into the narrowest part of the venturi tube insert of the prechamber, this being provided with passage-type openings.

Since a furnace system of this type, which provides for pulse combustion, requires no flue, the exhaust-gas temperature can be selected as low as is desired. In the sense of the most complete heat exchange possible, the heat exchange range for the waste-gas discharge system can be of a length that is considerably greater than the length of the exhaust pipe that generates the periodic oscillatory movement at the desired frequency in the column of exhaust gases. Thus, it is preferred that a baffle that reduces its cross-section be incorporated in the connector pipe of the waste-gas discharge system, and this then reduces the length of the pulsating column of exhaust gases. Acoustic dampers, heat exchangers, etc., of any kind and size can be incorporated after this baffle without any effect on the combustion process. The length of the pulsating exhaust-gas column between the base of the combustion chamber and the baffle that restricts the cross-section in the waste-gas connector pipe or the exhaust pipe corresponds preferably to fifteen times the length of the prechamber. It is preferred that each acoustic damper that is immersed in the heat-exchange medium be double-walled, the intervening space amounting to 2–3 mm. This helps prevent the formation of condensation water.

In a further embodiment it is foreseen that the combustion chamber has a cover plate on its side that is opposite the base of the combustion chamber, a vertical vortexing body being incorporated at the centre of said cover plate, with the connector pipe being arranged at the side and the vortexer body being preferably S-shaped. This embodiment, too, enhances the degree of mixing of the gases contained in the combustion chamber. In another embodiment, there are at least two connector pipes, preferably at different distances from the base of the combustion chamber and at least one of this can be closed off. The connector pipes can open out into a common intermediate container, which means that the heat-exchanger areas of the furnace system can also be controlled because it is possible to shut off one connector pipe.

Further to the above, it is conceivable that one of these connector pipes can be let into the hottest zone of the combustion chamber as a closable hot-gas extraction line which is led off to the outside through the base of the combustion chamber, in the opposite direction to the waste-gas discharge system. This can be led back into the heat-exchanger container and form an additional enlargement of the heat-exchanger area, with both being introduced into the exhaust pipe, for example, between two acoustic dampers. This type of hot-gas extraction line can, however, be used in a different fashion. Thus, in one embodiment it is foreseen that a part of the hot-gas extraction system forms a tube-type heater. The tube-type heater can function as a space heater and can also be incorporated in a helical coil to form a cooking surface.

In a preferred embodiment, in order to facilitate incorporation in existing central-heating systems it is foreseen that the combustion chamber be arranged on the inner side and the pre-chamber be arranged on the outside of a carrier plate secured to the outer side of the heat-exchanger container, and the furnace system form an insert ready for incorporation in the heat-exchanger container.

This means that the furnace system is a prefabricated installation unit that can be slid into the usual heating boiler or boiler in the case of a hot-water heating system or—in the case of a hot-air heating system—into the furnace which can, in like manner, be fired with solid fuel. The heat-exchange medium coil, however, be in the form of a suitable storage mass, such as concrete or aluminum, so that the furnace system is part of a heat-storage heating system.

Different variations are possible within the framework of the present invention, these mainly resulting in improved output control. Thus, it is possible to provide the combustion chamber with an increased number of prechambers, it being possible to supply these through separate fuel-supply lines.

Finally, it is also possible to provide a greater number of combustion chambers for the furnace system, the waste-gas discharge system of these leading to a common exhaust pipe. Here, there is automatic phase shifting amongst the individual combustion chambers, this resulting in more even and lower noise levels. The two latter embodiments offer a wider range of control of the furnace system.

The tests that follow were conducted using commercially-available furnace oil. A baffle with 26 mm clearance was incorporated in the prechamber as a vortexer, and the fuel was injected into the prechamber continuously at 18 bar injection pressure through a 0.45/60" nozzle. This resulted in a combustion output of approximately 26 kW.

| | Without inner combustion chamber | With inner combustion chamber gap approx 3 mm | With inner combustion chamber gap approx 0.3 mm |
|---|---|---|---|
| CO (ppm) | 17 | 13 | 15 |
| $CO_2$ (%-vol) | 13.9 | 14 | 14 |
| NOX (ppm) | 23 | 41 | 24 |
| Soot index (Bacharach) | 0 | 0 | 0 |

As can be seen very clearly, the double-shell combustion chamber with a gap 0.3 mm wide provides very favourable exhaust-gas values.

This combustion chamber was used for further tests in which the vortexing baffle was used with a clearance of 28 mm and with a combustion-chamber base distance of 12 mm in the prechamber. The tests were conducted one at 11 bar oil injection pressure (burner output approximately 14 kW) and at 22 bar oil injection pressure (burner output approximately 30 kW). The following values resulted.

1. Oil injection pressure 11 bar.
Combustion-chamber temperature approximately 1100° C.

| Waste-gas-Temp | 85° C. | 66° C. | 96° C. | 94° C. |
|---|---|---|---|---|
| $O_2$ | 4.5% | 4.5% | 4.5% | 4.6% |
| CO | 21 PPM | 11 PPM | 18 PPM | 19 PPM |
| $CO_2$ | 12.0% | 12.0% | 12.0% | 11.9% |
| $SO_2$ | 109 PPM | 108 PPM | 116 PPM | 109 PPM |
| NOX | 16 PPM | 14 PPM | 20 PPM | 17 PPM |

2. Oil injection pressure 22 bar.
Combustion-chamber temperature approximately 1150° C.

Waste-gas-

-continued

| Temp | 95° C. | 96° C. | 96° C. | 100° C. | 86° C. |
|---|---|---|---|---|---|
| $O_2$ | 1.9% | 2.4% | 2.0% | 2.0% | 2.1% |
| CO | 37 PPM | 32 PPM | 40 PPM | 39 PPM | 37 PPM |
| $CO_2$ | 13.9% | 13.5% | 13.8% | 13.8% | 13.7% |
| $SO_2$ | 132 PPM | 127 PPM | 131 PPM | 131 PPM | 124 PPM |
| NOX | 27 PPM | 20 PPM | 23 PPM | 23 PPM | 21 PPM |

Exemplary versions of the present invention are described below with reference to the drawings appended hereto.

Figure 1:
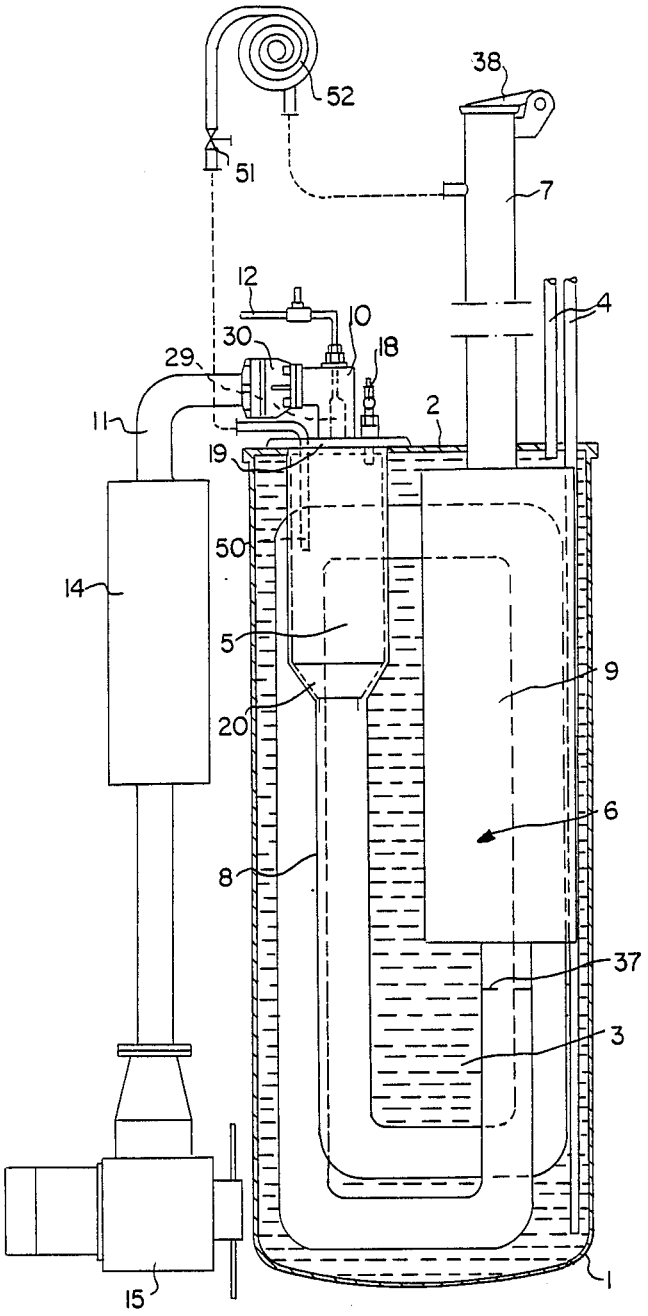
FIG. 1 shows a cross-section through a first embodiment of a furnace system according to the present invention.

FIGS. 8 to 11 provide a schematic representation of the induction, compression, combustion and exhaust phases of the operating cycle.

A heat-exchanger container 1, configured in the exemplary version shown herein as a heating boiler filled with water 3, and forming part of a central-heating system 4, is of cylindrical shape and closed off by an upper face plate. The upper face plate serves as a carrier plate 2 for a furnace system with a combustion chamber 5 to provide for the pulse combustion of—in particular—liquid fuels. The combustion chamber 5 is inserted into an opening in the carrier plate 2 and, in the version shown in FIGS. 1 to 4, makes a transition through a conical end section 20 to a connector pipe 8. This is angled several times as part of a waste-gas discharge system 6, and passes through the heat exchanger container 1 to open into a double-walled acoustic damper 9, from which an exhaust pipe 7 conducts the combustion gases to the outside atmosphere. The exhaust pipe 7 is fitted with a cap 38 that prevents a through draft and helps avoid rapid cooling of the furnace system when it ceases operation. Preferably there are two or three acoustic dampers 9 arranged in series. Within the connector pipe 8 there is a choke 37 that serves to reduce the cross-section of the pipe 8; the length of the pulsating column of waste gas can be limited by the distance between this baffle and the combustion chamber 5. The combustion chamber 5 is secured to a face plate 25 (FIG. 3) and forms a container insert that is secured to the carrier plate 2 and slid into the heat-exchanger tank 1. This also makes it possible to retrofit the unit to existing heating systems in a very simple manenr. A prechamber 10 is also secured to the outside of the face plate 25. This prechamber is essentially cylindrical and the fuel supply line 12, which can be closed off, for example, by a solenoid-operated valve, opens into it axially and an air-supply line 11, provided with a one-way valve system 30, opens into it from the side. An induction noise damper 14, a fan 15, and a control system and other ancilliary assemblies, not shown herein, complete the furnace system as an assembly and installation unit according to the present invention.

Figure 2:
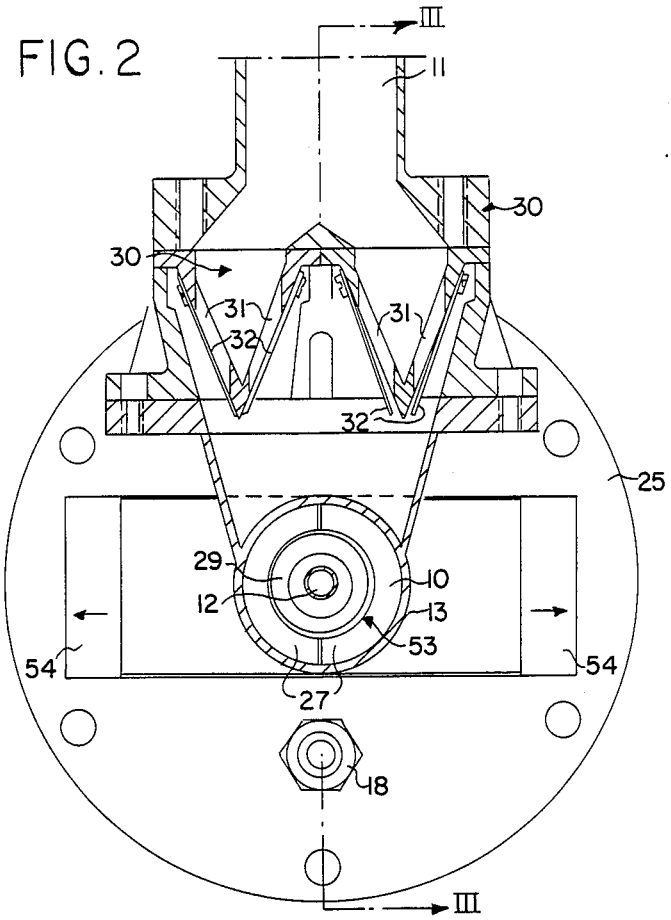
FIG. 2 is a cross-section through the prechamber, on the line II—II in FIG. 3.
Figure 3:
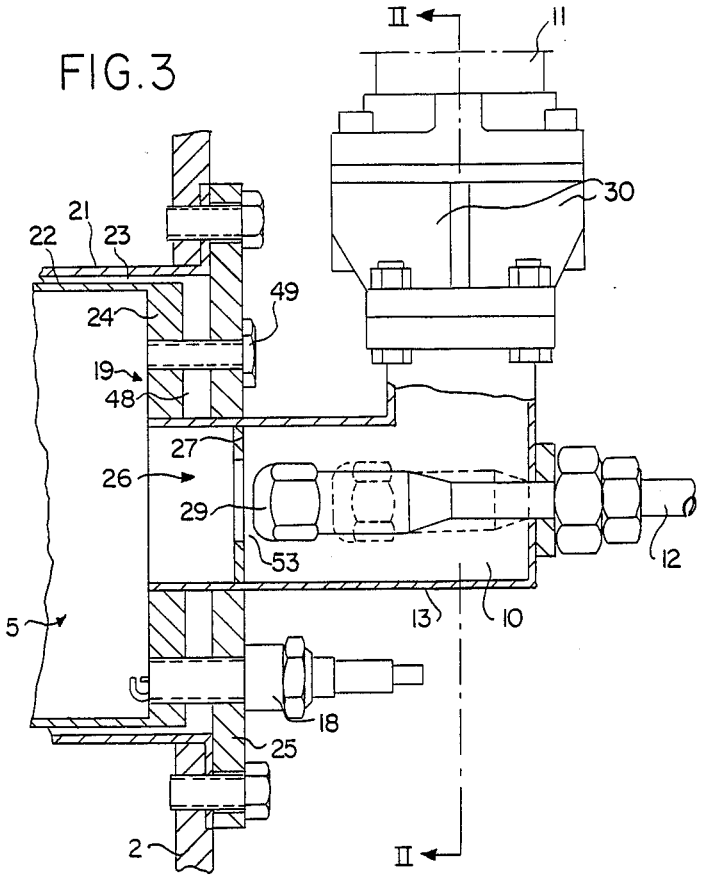
FIG. 3 is a partial cross-section through the prechamber on the line III—III in FIG. 2.

As can be seen particularly clearly in FIGS. 2 and 3, the combustion chamber 5 is double-walled, with the outer shell 21 being connected by means of the face plate 25 to the carrier plate 2; this makes the transition to the connector pipe 8 (FIG. 1), whereas the inner shell 22, with an air gap 23 of preferably 0.3 mm left between it and the outer shell 21, extends from the base of the combustion-chamber 19 through the conical end section 20 of the combustion chamber 5 to the connector pipe 8 (FIG. 1, and FIGS. 7 to 11). The combustion chamber base 19 is also double-walled and has in internal heat shield 24 and the face plate 25 on the outside. Thus, the heat shield 24 and the face plate 25 define a gap 48 at the base, this preferably amounting to 10 mm, so that a "hot" inner chamber results, this being connected exclusively by the bolts 49 to the outer portion. The end of the prechamber 10 extends through the face plate 25 as far as the heat shield 24 as part of a flame retainer 26. This simultaneously forms a vapourizer plate to vapourize the fuel mist that is mixed and then vortexed together with the air in the vicinity of the passage opening into the combustion chamber 5 by the diffusor action of a vortexing element 27.

Figure 7:
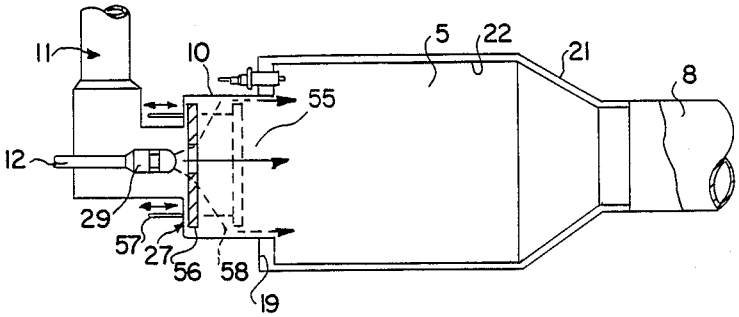
FIG. 7 is a second variation of the prechamber shown in FIG. 3.

The vortexing element 27 can be formed, for example, by a baffle that is incorporated in the prechamber 10 (as in FIGS. 3,4,8–11) or, as in FIG. 7, it can consist of an wider section 55 in the prechamber 10. In this connection, as is shown in FIG. 4, a venturi tube insert is also used and as is shown in the embodiment as in FIG. 7, a baffle 56 is inserted into the wider section 55.

A spark plug 18, which is used for the initial ignition of the furnace system, protrudes through the base 19 of the combustion chamber (FIG. 3). The fuel supply line 12 that enters the prechamber 10 axially terminates in an injection nozzle 29 through which liquid fuel is injected continuously into the combustion chamber 5, at a pressure of preferably 10 and 25 bar; this fuel can be furnace oil, waste oil, or the like. The injection nozzle 29 is preferably axially adjustble, as is indicated by the dashed lines, and its foremost position is just behind the vortexer element 27, which leaves an air gap 53. In order to control the output of the furnace system the choice of the oil injection pressure and the dimension of the air gap 53 is important, since by this means it is possible to achieve in any position an almost stoichiometric air-fuel ratio for optimal combustion. Alteration of the air gap 53 can be effected by the above-described axial displacement of the injection nozzle 29, or by changing the width of the opening of the vortexing element 27, if this is configured as a baffle. FIG. 2 shows this schematically; here, the baffle is formed by two slides set in two recesses 54 in the face plate 25; these have cut-outs that are directed towards each other and overlap, so that the baffle opening formed by the two cut-outs changes when they are moved. In FIG. 7, the displacement of the baffle 56 in the wider section 55 of the prechamber 10 parallel to the fuel supply line 12, which is necessary for changing the air gap 53, is shown schematically. One movement of the baffle 56, that is fixed on longitudinal guide elements 57, in the direction of the combustion chamber 5, an addition annular gap (indicated by the dashed arrow 58) is opened between the baffle 56 and the wall of the wider section 55. The measures adopted to change the air gap 53 can also be applied in combination. The proper adjustment permits combustion with the above-described blue flame.

The air-supply line 11 branches off from the side of the housing 13 of the prechamber 10, and the non-return valves 30 are incorporated in this line. These have a total throughput area that is greater than the cross-sectional area of the prechamber 10. The non-return valves 30 are provided with V-shaped, preferably slightly convex valve seats 31 to which flat valve flaps 32 are secured. Because of the over-dimensioned total cross-sectional area, the valve flaps 32 subtend a small opening angle, with the result that they are subjected to very insignificant bending loads.

Figure 4:
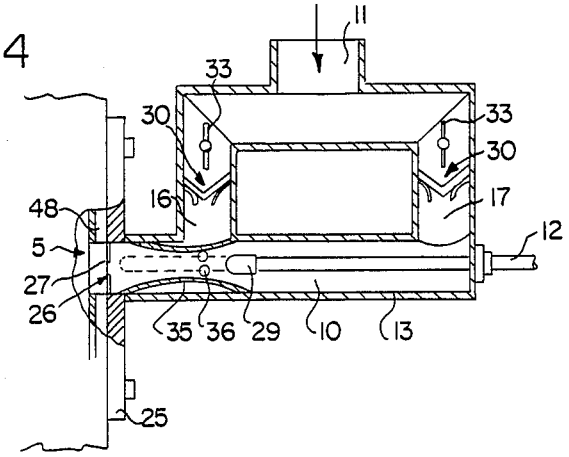
FIG. 4 shows a variation of the prechamber shown in FIG. 3.

In the variation of the prechamber shown in FIG. 4 the air-supply line splits into two branches 16, 17, with a non-return valve 30 in each branch; each branch can be closed off by means of a falp 33, which contributes to a further increase in the controllability of the furnace system. Also as a means of increasing the control range, the valve flaps 32 of the individual valves 30 display different materials characteristics so that they have differing bending and flexing characteristics. For this reason, the valve 30, of which the valve flaps 32 are softer, opens sooner and the second opens only when there is a requirement for more air. In the version shown in FIG. 4, the valve closest to the combustion chamber in the branch 16 is fitted wth softer valve flaps 32, through which the shorter flow path also leads into the combustion chamber 5. The valves 30 in the side branches are not exposed directly to the high prevailing temperatures in the combustion chamber, which can reach 1200° C., in which connection the continuous supply of fuel through the injection nozzle 29 also contributes to the cooling effect. The branches 16, 17 are also so arranged that when the injection nozzle 29 is in its furthest withdrawn position it lies between the two branches 16, 17. By this means, a stratified charge in the combustion chamber 5 is achieved, since during the induction stage at first a fuel-depleted air-fuel mixture (air via the branch 16), then a fuel-enriched, and finally once again a fuel-depleted air-fuel mixture (air via the branch 17) is moved into the combustion chamber. In FIG. 4, there is also a cross-section restriction in the prechamber 6 caused by a venturi-tube insert that has passage openings 36 through which the air enters from the branch 16. In this embodiment in particular, the adjustability of the injection nozzle 29 also results in possibilities for finer control of the furnace system, since both end positions lie ahead of or behind the venturi tube.

Figure 5:
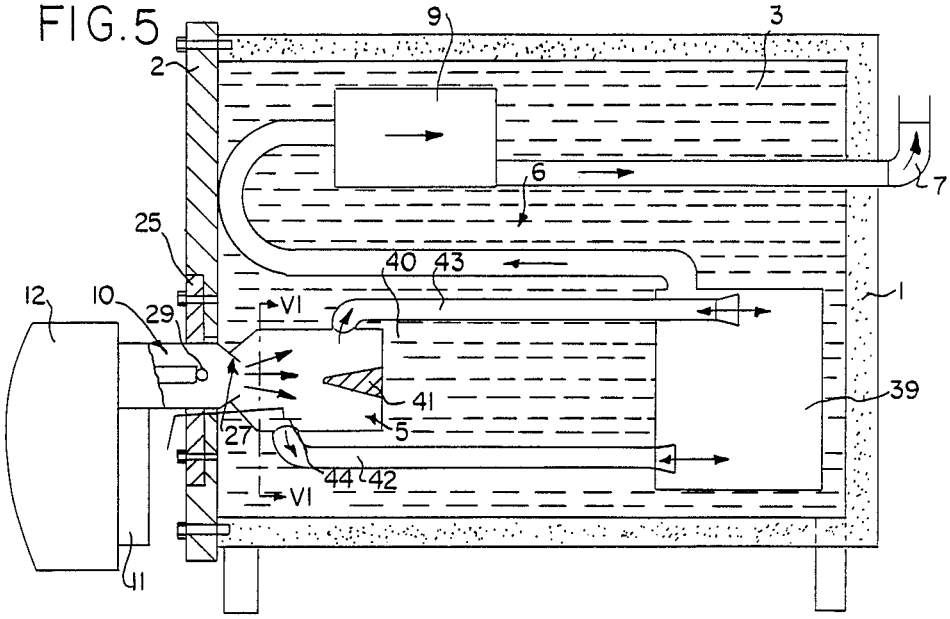
FIG. 5 is a longitudinal cross-section through a second exemplary version.
Figure 6:
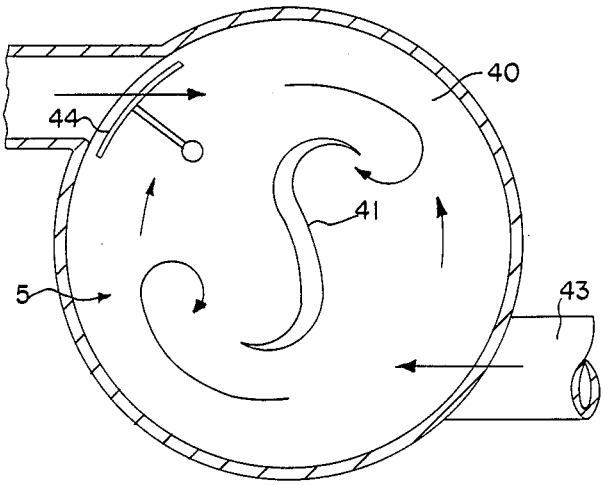
FIG. 6 is a cross-section on the line VI—VI shown in FIG. 5.

FIGS. 5 and 6 show a further embodiment in which the furnace system mounted on the carrier plate 2 is once again configured as a tank insert. In this embodiment, the combustion chamber 5 is pot-like and on its face side that is opposite the base of the combustion chamber is closed off by a cover plate 40, from which, centrally, an approximately S-shped vortexer body 41 protrudes (FIG. 6).

Two connector pipes 42, 43 branch off tangentially from the sides of the combustion chamber 5, and these open into the same chamber 39, by which the length and frequency of the pulsation column of exhaust gas is defined. The two connector pipes 42, 43 branch out opposite to each other at different levels from the combustion chamber 5, with the connector pipe that is closest to the prechamber 10 being closable by means of a lock means that can be operated from outside the system. This, too, permits control of the furnace system. Of course, the second connector pipe 43 can also be made so as to be closable. The remaining constructional details of the furnace system correspond essentially to the above-described furnace system that is illustrated in FIGS. 1 to 4, However, here the the prechamber 19 protrudes into the combustion chamber 5, and the vortexing element 27 at the opening of the prechamber 10 is formed by this nozzle. The diffusor effect occurs outside the vortexing element, in the annular space towards the base of the combustion chamber.

The waste gases that are discharged, that have been cooled down by heat exchange with the heating medium of the space or central-heating system, require no flue, so that the waste-gas discharge system 6 can be designated as an exhaust system. The waste gases that are discharged, that pass through one or a plurality of acoustic dampers 9, can also be used to drive a generator through the medium of a turbine wheel, which will then produce the current required for the fuel pump, the solenoid valve in the fuel supply line 12 and the fan that is needed for starting the furnace system, so that they are independent of the power supply for the energy needed for the ancilliary systems. The current that is produced is stored in an accumulator battery, for example, an automobile battery.

In FIG. 1, an extra connector pipe 50 is shown; this ends in the hottest area of the combustion chamber 5 and in the opposite direction leads to the main connector pipe 8 of the waste-gas discharge system 6 through the base of the combustion chamber 19 to the outside. This connector pipe 50 is a hot-gas removal line that, as a hot-air source, can serve, for example, as a tube-type heater or, as is shown schematically, as a spiral-wound tube, can serve as a cooking surface 52. The connector pipe 50 can be operated by a valve 51 and leads back to the exhaust pipe 7. The hot-gas removal line can also be used to increase the waste-gas temperature in the exhaust pipe 7.

Figure 10:
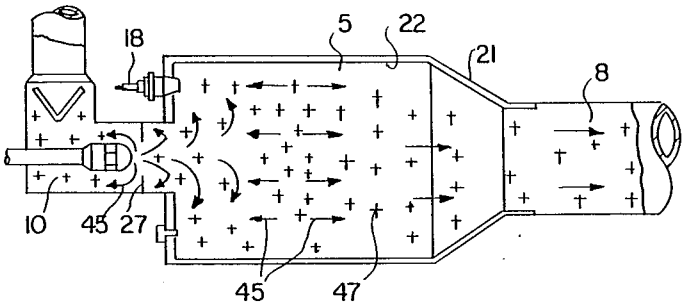
Figure 11:
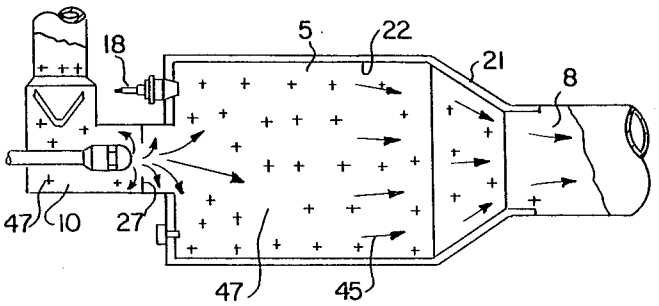
Figure 8:
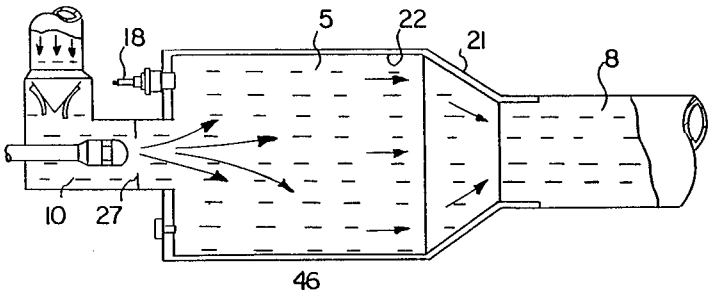
Figure 9:
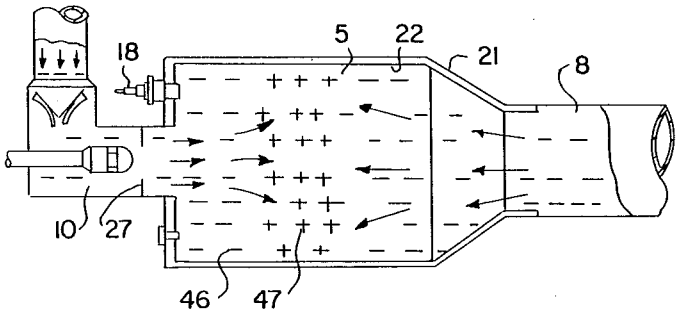

FIGS. 8 to 11 provide a schematic representation of the phases in the combustion process. In the induction phase shown in FIG. 8 there is a partial vacuum in the combustion chamber 5, in the connector pipe 8 and in the prechamber 10; (this is indicated by dashes 46), so that air is added to the constantly incoming fuel. The vortexing element 27 vortexes the resulting mixture as has been described and as shown in FIG. 9 this is compressed by the exhaust-gas wave flowing back from the connector pipe 8. Pressure builds up (as indicated by the crosses 47), whereupon the hot waste gases and the high temperature of the flame retainer initiate automatic ignition, as is shown in FIG. 10. A pressure wave spreads (as indicated by the arrow 45) to both sides, whereupon the valves 30 in the prechamber close. FIG. 11 shows the exhaust phase, in which the exhaust gases (arrow 45) pass through the connector pipe 8 and a partial vacuum once again comes about in the combustion chamber, as in FIG. 8. Since, during the the whole time, fuel is injected continuously, the very fine atomization, vapourization and optimal mixing with the combustion air that brings about high-quality combustion is plain.

I claim:

1. A furnace system for an installation that has a heat exchanger, preferably water filled, comprising:

at least one combustion chamber for the pulse combustion of free flowing fuels, which is provided with an ignition system for the initial ignition of the fuel and makes a transition to a waste-gas disposal system;

a pre-chamber having a transitional area into the combustion chamber;

a supply line for a preferably continuous supply of fuel under pressure, which ends in an injection nozzle arranged in said pre-chamber;

a supply line for air which has at the inlet into said pre-chamber a non-return valve system for the intermittent supply of air;

a vortexing element arranged in the transitional area of said pre-chamber, changing the cross-sectional area of the prechamber, and swirling the air-fuel mixture on its combustion chamber side, and;

a control device for the supply of air, by means of which the air passage area between the pre-chamber and the combustion chamber is adjustable to optimize the supply of air in view of the stoichiometric mixture of fuel and air.

2. A furnace system according to claim 1, wherein the pre-chamber is substantially cylindrical, and the fuel supply line extends axially into the pre-chamber, said control device comprising said injection nozzle and an element changing the cross-sectional area of the pre-chamber, which together define an annular gap variable in dimension.

3. A furnace system according to claim 2, wherein the injection nozzle is axially adjustable between a front end position next to the element changing the crosssectional area and a rear end position.

4. A furnace system according to claim 3, wherein the air supply line comprises two branches wherein the rear end position of the axially adjustable injection nozzle lies between the two branches of the air supply line.

5. A furnace system according to claim 1, wherein the air supply line has two branches, these opening out into the pre-chamber at the sides, in which connection of at least one branch can be closed off separately.

6. A furnace system according to claim 1, wherein the element changing the cross-sectional area of the pre-chamber is in the form of a baffle.

7. A furnace system according to claim 6, wherein the opening of the baffle is adjustable.

8. A furnace system according to claim 6, wherein the baffle is axially adjustable.

9. A furnace system according to claim 6, wherein the baffle is formed by said vortexing element.

10. A furnace system according to claim 6, wherein the baffle is arranged at an interval from the combustion chamber in a wider section of the pre-chamber, the wider chamber forming said vortexing element.

11. A furnace system according to claim 2, wherein said element changing the cross-sectional area of the pre-chamber is formed by a venturi tube insert.

12. A furnace system according to claim 4, wherein the branch of the air supply line that is closest to the combustion chamber opens out at the narrowest part of a venturi tube insert of the pre-chamber that is provided with passage-type openings.

13. A furnace system according to claim 1, wherein the non-return system of the air supply line comprises a pair of non-return valves having V-shaped valve seats and a pair of valve flaps, the total opening cross-section of the non-return valve system is greater than the cross-section of the air supply line.

14. A furnace system according to claim 13, wherein the valve flaps of the non-return valves are of different materials, in which connection the non-return valve in the branch that is closest to the combustion chamber has valve flaps which are less resistant to bending or flexing.

15. A furnace system according to claim 6, wherein a baffle is installed in the waste-gas disposal system and said baffle defines the length of the pulsating column of waste gas.

16. A furnace system according to claim 1, wherein the length of the pre-chamber is approximately one fifteenth of the length of the pulsating column of waste-gas between the combustion chamber base and the baffle in the waste-gas disposal system.

17. A furnace system according to claim 1, wherein the combustion has a cover plate on the face side that is opposite the combustion chamber base, fromthe center of which rises a vortexer body, the connector pipe being located at the side.

18. A furnace system according to claim 17, wherein the vortexer body is S-shaped.

19. A furnace system according to claim 1, wherein the waste-gas disposal system comprises at least two connector pipes arranged at different distances from the combustion chamber base, in which connection of at least one of the connector pipes can be shut off.

20. A furnace system according to claim 19, wherein the closable connector pipe ends at a hot-gas removal line in the hottest zone of the combustion chamber and is led through the combustion chamber base to the outside.

21. A furnace system according to claim 20 wherein a part of the hot-gas removal line forms at least one tubular type heater body.

22. A furnace system according to claim 1, wherein the combustion chamber is arranged on the inner side and the pre-chamber on the outer side of a carrier plate secured on the heat exchange container, and the furnace system forms an insert for the heat exchange container that is ready for installation.

23. A furnace system for an installation having a water filled heat exchange container, with at least one combustion chamber for the pulse combustion of fuels, this being provided with an ignition system for the initial ignition of the fuel and making a transition to a waste-gas discharge system, in which connection the combustion chamber is accommodated in an opening in the heat exchange container such that together with a portion of the waste-gas discharge system it is surrounded by water and a pre-chamber lies outside the heat exchange container, with feed lines for fuel and for air, in which connection to the latter has at the inlet into the pre-chamber a non-return device so as to provide for the intermittent supply of air, wherein in for use in a space or central-heating system with a water boiler, the combustion chamber has a double jacket that includes a compensator gap.

24. A furnace system according to claim 23, wherein the base of the combustion chamber consists of two base plates arranged at a distance from each other, of which the inner plate forms a heat shield and the outer plate forms a carrier plate.

25. A furnace system according to claim 24, wherien the heat shield together with the inner shell forms an insertable hot chamber, that extends into the waste-gas discharge system.

26. A furnace system according to claim 23, wherein a baffle is installed in the waste-gas disposal system and defines the length of the pulsating column of wastegas.

27. A furnace system according to claim 26, wherein the length of the pre-chamber is approximately one fifteenth of the length of the pulsating column of waste-gas between the combustion chamber base and the baffle in the waste-gas disposal system.

28. A furnace system according to claim 23, wherein the combustion chamber has a cover plate on the face side that is opposite the combustion chamber base, from the center of which rises a vortexer body, the connector pipe being located at the side.

29. A furnace system according to claim 28, wherein the vortexer body is S-shaped.

30. A furnace system according to claim 23, wherein the waste-gas removal system comprises at least two connector pipes arranged at different distances from the combustion chamber base, in which connections of at least one of the connector pipes can be shut off.

31. A furnace system according to claim 30, wherein the closable connector pipe ends as a hot-gas removal line in the hottest zone of the combustion chamber base to the outside.

32. A furnace system according to claim 31, wherein a part of the hot-gas removal forms at least one tubular type heater body.

33. A furnace system according to claim 23, wherein the combustion chamber is arranged on the inner side and the prechamber on the outer side of a carrier plate secured on the heat exchange container, and the furnace system forms an insert for the heat exchange container that is ready for installation.

* * * * *